US007096811B2

(12) United States Patent
Clarke et al.

(10) Patent No.: US 7,096,811 B2
(45) Date of Patent: Aug. 29, 2006

(54) AUTONOMOUS SWIMMING CARGO CONTAINERS

(75) Inventors: Robert A. Clarke, Poolesville, MD (US); William M. Teppig, Jr., Mt. Airy, MD (US)

(73) Assignee: Advanced Engineering & Planning Corporation, Inc., Rockville, MD (US)

( * ) Notice: Subject to any disclaimer, the term of this patent is extended or adjusted under 35 U.S.C. 154(b) by 0 days.

(21) Appl. No.: 10/848,198

(22) Filed: May 18, 2004

(65) Prior Publication Data

US 2004/0237870 A1 Dec. 2, 2004

(51) Int. Cl.
*B63B 25/00* (2006.01)

(52) U.S. Cl. ..... 114/72; 114/256

(58) Field of Classification Search ..... 114/256, 114/258, 259, 72, 73, 242, 248; 414/137.1, 414/139.4

See application file for complete search history.

(56) References Cited

U.S. PATENT DOCUMENTS 2,988,036 A * 6/1961 Mooneyhan et al. ..... 114/72
3,841,254 A * 10/1974 Dragonas et al. ..... 114/77 R
3,913,512 A * 10/1975 Kirby et al. ..... 114/260
4,226,189 A * 10/1980 Bertolini ..... 105/423
4,421,050 A * 12/1983 Weinert ..... 114/256
4,898,112 A * 2/1990 McGlew et al. ..... 114/259
5,006,031 A 4/1991 Fossing et al.
5,597,335 A 1/1997 Woodland
5,613,814 A 3/1997 Jackson
5,632,661 A 5/1997 Jurgens et al.
5,713,293 A 2/1998 Shifler et al.
5,774,876 A 6/1998 Woolley et al.
5,795,199 A 8/1998 Langenberg et al.
5,823,225 A 10/1998 Erickson et al.
5,908,122 A 6/1999 Robinett et al.
5,947,051 A 9/1999 Geiger
6,129,506 A * 10/2000 Hagenbuch ..... 414/803
6,269,763 B1 8/2001 Woodland
6,321,673 B1 11/2001 Lelan et al.
6,352,399 B1 3/2002 Martin et al.
6,354,235 B1 * 3/2002 Davies ..... 114/246
6,427,615 B1 8/2002 Ku
6,474,254 B1 11/2002 Ambs et al.
6,494,159 B1 12/2002 Sirmalis et al.
6,496,765 B1 12/2002 Robinett, III et al.
2004/0056029 A1 * 3/2004 Petzitillo ..... 220/1.5

* cited by examiner

*Primary Examiner*—Stephen Avila
(74) *Attorney, Agent, or Firm*—Holland & Knight LLP

(57) ABSTRACT

The present invention provides an apparatus, method and system for delivery of commercial cargo containers shore side without container terminals. The present invention utilizes containers made autonomous by coupling a container with a detachable propulsion system, having a motor and navigation and steering controls, permitting the rapid, controlled, efficient and safe delivery of cargo containers individually by water. Ballast units, deployment systems and control via remote units are also disclosed. These improvements allow the containers, utilizing their inherent buoyancy, to approach a shore autonomously according to a preplanned or remote controlled route to a specific location and in a specific order of arrival, thereby reducing the number of cargo handlers required, speeding the delivery process to the shore, and eliminating the need for high-technology pier-side equipment. The present invention allows the transfer of cargo at primitive shore sites as well modern pier facilities, and expedites the delivery of such cargo wherever needed.

16 Claims, 7 Drawing Sheets

AUTONOMOUS SWIMMING CARGO CONTAINERS

BACKGROUND OF THE INVENTION

1. Field of the Invention

The present invention relates generally to maritime operations, and more particularly to systems for moving cargo containers.

2. Related Art

In the past, maritime cargo operations consisted of moving numerous small items like boxes, drums, and crated goods, using cranes and physical labor to load and off-load these from the transport ships. Although dockside transport was more efficient, it was still common to move goods to or from undeveloped shorelines. With the increased volume of international trade, much more efficient means of moving goods arose within the maritime shipping industry. Today, the vast majority of maritime cargo is moved via intermodal containers, allowing for huge volumes to be efficiently moved between key ports. As a result, most of today's shipping is configured for carrying and utilizing commercial cargo containers.

Commercial cargo containers are, for the most part, manufactured according to specifications set by the International Organization for Standardization (known as the "ISO"). These specifications include standards for strength, water-tightness, mobility, and security. Their size is typically forty feet long, eight feet wide and eight feet, six inches high (i.e., 40'×8'×8'6"), and can weigh over thirty-four tons fully loaded with a capacity of over 2,720 cubic feet. Other ISO standard containers can measure 20'×8'×8'6", 45'×8'×8'6" or 45'×8'×9'6". When referring to commercial containers, we mean these or similarly strong and large (4' or more) containers for cargo, regardless of use for commercial, non-profit or governmental purposes.

Today's deep draft, large cargo vessels, which are configured for carrying and utilizing ISO standard cargo containers and the like, cannot approach shallow shores or even ports. They must use modern port facilities with special cargo handling equipment (e.g., cranes, etc.) or must be off-loaded outside the surf zone and their containers transferred to the beach via smaller craft. The latter method is highly inefficient because it requires delicate alignment of the containers while transferring containers between dynamic, floating platforms with the transfer crane introducing additional motion. Also, the smaller craft must return from the beach empty to pick up another load, greatly reducing their productivity.

Several systems exist which may deliver cargo containers either through or over the surf zone. The most commonly used method is lighterage which uses a small boat that is large enough to hold one or more commercial containers in its well deck. The smaller boat pulls along side the container ship and a container is placed aboard it using a crane. The smaller boat is then driven to the beach by its crew. This type of boat has a shallow draft that allows it to approach the beach and a ramp that is dropped onto the beach to allow the cargo container to be transferred to the beach. The emptied small boat must then return to the container ship to repeat the cycle. This solution, however, also suffers from a low transfer rate due to required return trips to the large ship while empty. This is further impacted by the required distance the large ship must remain off shore.

Greater transfer rates are possible from ships from which the containers on wheels may be driven off. These ships are called roll-on, roll-off (RO-RO) ships. Their use at a primitive beach or shore facility, however, requires a beach with an atypically steep slope that allows the deep container ship to approach the shore or the construction of a pier.

Thus, while today's intermodal container system is a huge benefit to all and critical to international trade, it also gives rise to the drawbacks highlighted above. Because of the expense of a high-volume dockside container facility, these tend to cater to specialized ships. These ships in turn only operate efficiently—sometimes only—at the larger ports, which have the high-volume facilities. If goods being transported by containers are destined for small ports or unimproved shoreline, they must be transported by land or broken up and re-loaded as break-bulk goods for local operations. Further, because of the volume of shipment by intermodal containers, there are fewer vessels in service equipped for break-bulk or lighterage transport, and the time and expense for secondary transport (after container transport to a large port) is increasingly prohibitive. Moreover, in some applications where it is still highly desirable to use container shipment to primitive locations (e.g., military logistics), significant expense and time is needed to set up temporary off-loading facilities. This is far from ideal, because it is too expensive for commercial operations, but still slow and vulnerable to attack. With respect to amphibious lighters, these are difficult to load in an open sea. The relative motion of the rolling container ship, the container's swinging on the crane bridle, and the lighter's bobbing on the waves make insertion of a container into the lighter a slow operation. RO-RO ships used on an average beach require construction of a temporary causeway that allows the containership's ramp to discharge its containers to it while the ship stays in water deep enough for its draft. This process, however, adds to the time required before cargo is transferred and increases the costs involved.

Given the advantages and dependence on maritime container shipping, but the disadvantages noted above, what is needed is an improved apparatus, system and method for moving maritime cargo containers to locations that are not equipped with a high-volume container facility.

SUMMARY OF THE INVENTION

The present invention provides a method, apparatus, and system for self-propelled maritime cargo container transport. In an exemplary embodiment, an autonomous swimming cargo container ("ASCC") includes a standard ISO shipping container fitted with a transporter. The transporter includes a propulsion unit and controller. The propulsion unit includes an engine (with associated fuel supply, lubrication, air inlets, exhaust, starting system and power controllers), a propulsion subsystem (with associated drive shaft, propulsor and steering componentry) and interfaces (including associated container interfaces, equipment support fixtures, hydrodynamic fairings and inlet and access openings). The controller includes an antenna, navigation lighting and processor, a communications unit (with associated telecommunication interfaces and software input/output ports), and inventory and other optional controls. It may also include a fore ballast unit.

Further features and advantages of the invention as well as the structure and operation of various embodiments of the present invention are described in detail below with reference to the accompanying drawings.

BRIEF DESCRIPTION OF THE FIGURES

While the claims set forth certain novel features of the invention, the invention itself, together with certain objectives and advantages, may best be understood by reference to the following detailed description of an illustrative, presently preferred embodiment thereof, when read in conjunction with the accompanying drawings, of which:

DETAILED DESCRIPTION

Figure 1:
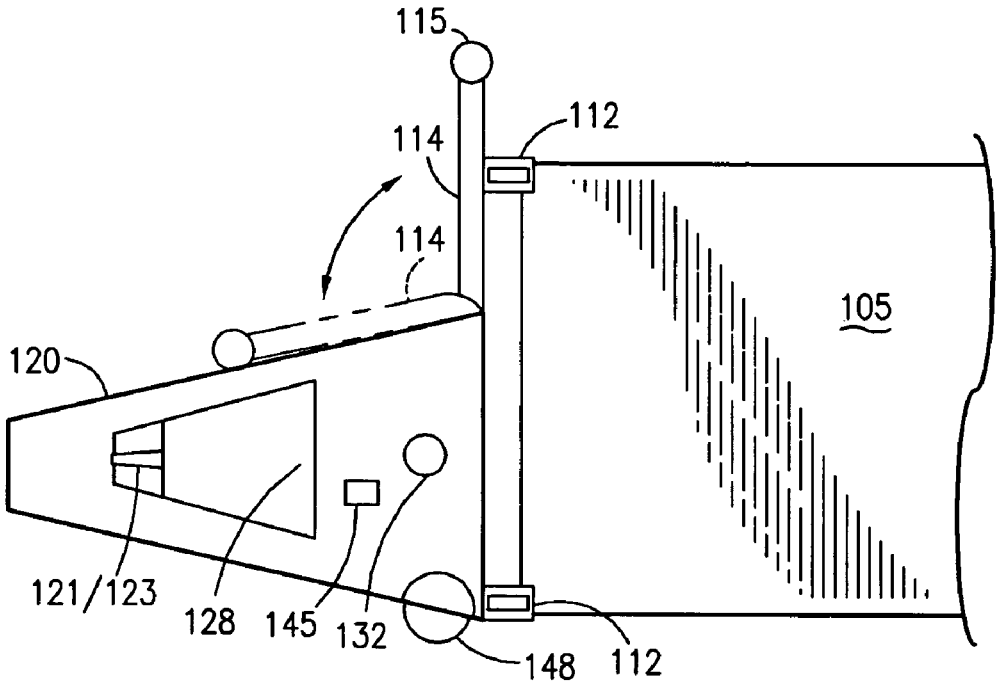
FIGS. 1 through 4 are side perspective, side cross-sectional, rear perspective and block diagram views, respectively, of a propulsion unit illustrative of a first embodiment of the invention.
Figure 3:
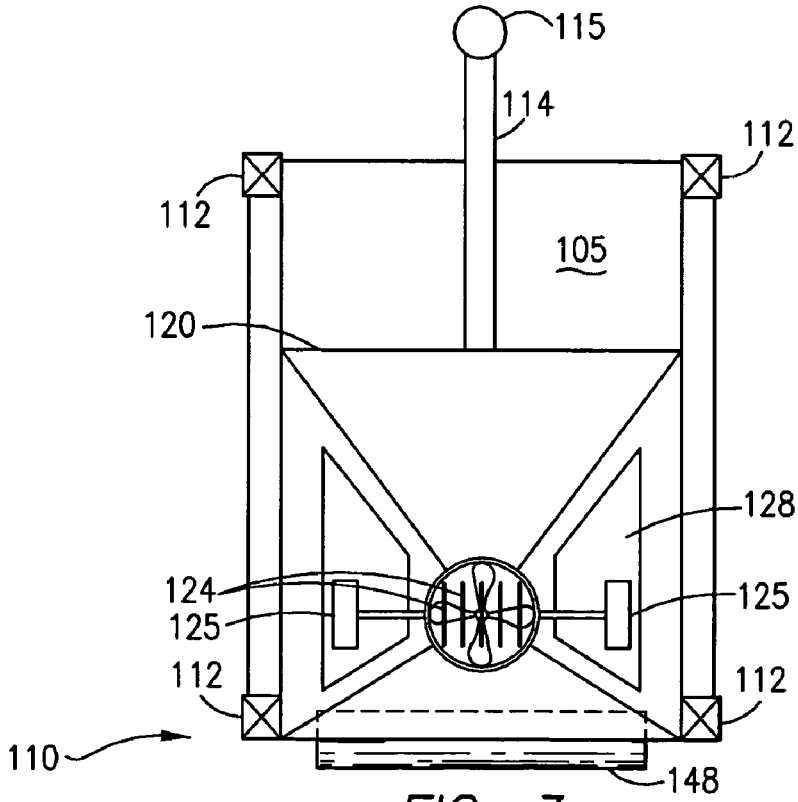
Figure 2:
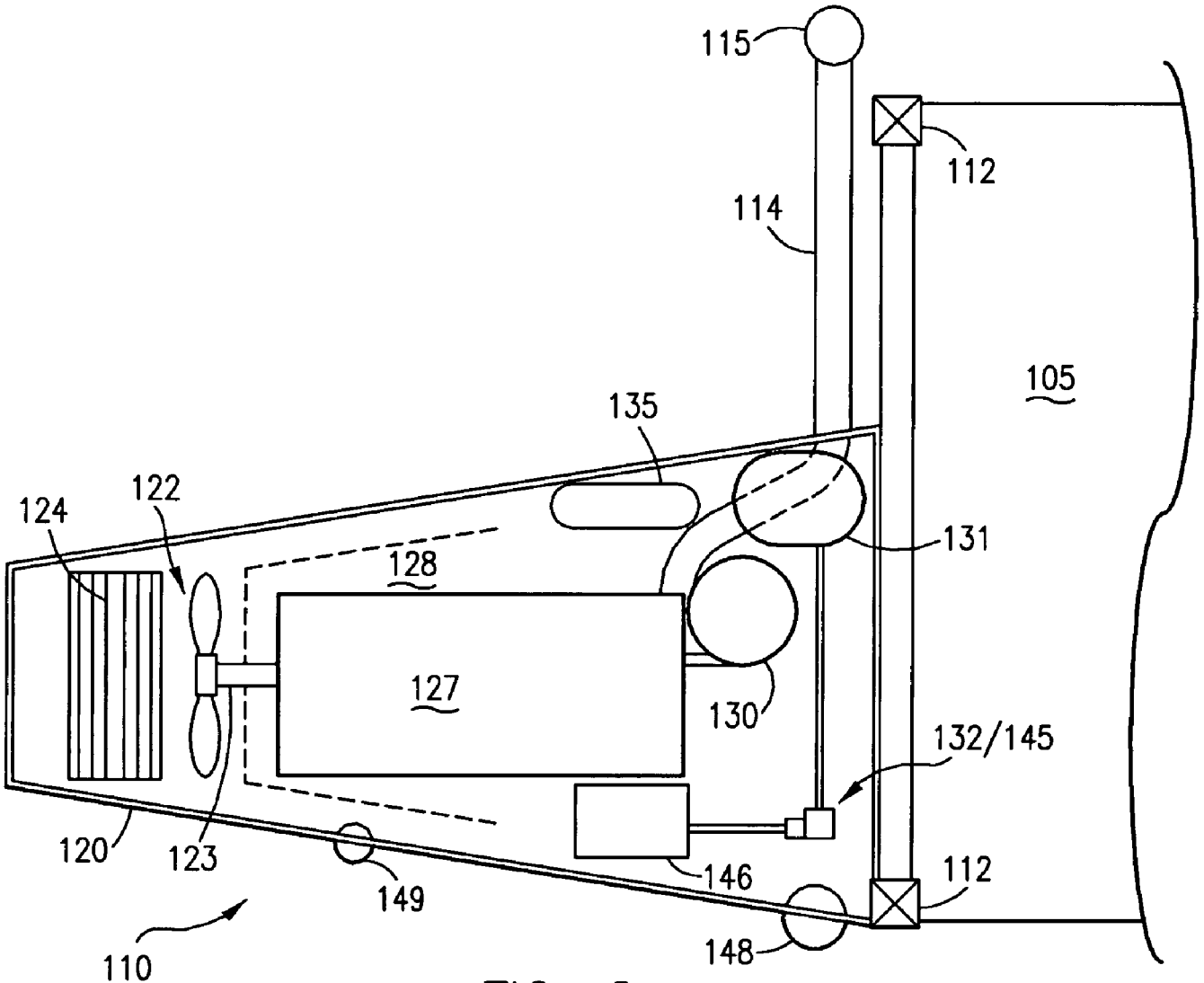
Figure 4:
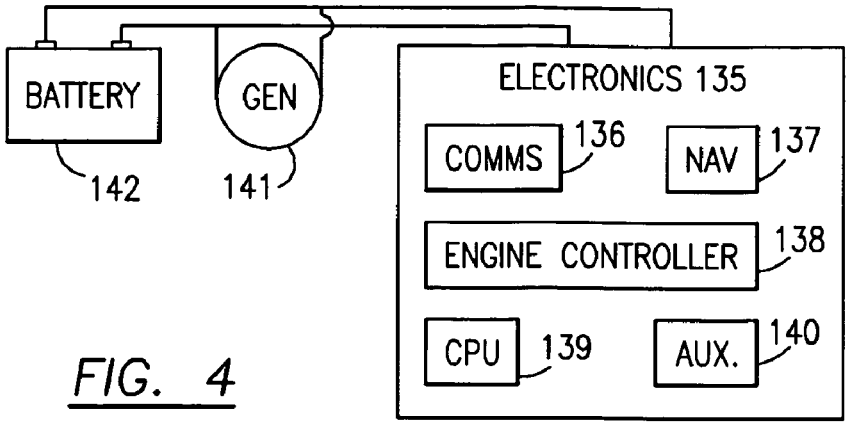

The limitations of prior systems described above are overcome by the novel improvements of our invention, which are illustrated by the following presently preferred embodiment. This embodiment is directed to an apparatus, method and system for autonomous maritime movement of cargo containers. For convenience we refer to this embodiment as an autonomous swimming cargo container ("ASCC"). The major system elements of the ASCC are the propulsion unit 120, the ballast unit 160 and the container 105, as well as remote units that interact with an ASCC. The present invention also provides methods of operation for the ASCC and remote/supporting systems.

While the present invention is described below in greater detail, this is for convenience only and is not intended to limit the application of the present invention. In fact, after reading the following description, it will be readily apparent to one skilled in the relevant art(s) how to implement the following invention in alternative embodiments, depending on the application and specific design choices.

With reference now to the figures and in particular with reference to FIGS. 1 through 4, an ASCC is depicted in accordance with certain presently preferred embodiments of the invention. Individual elements are each numbered, with the same number used in all FIGS. for the same element.

The Container.

The biggest unit of the ASCC is typically a standard, sealed, commercial cargo container 105. In the preferred embodiment, the ASCC requires no modification to a standard ISO intermodal container. Where needed, specialized containers can also be used, and the propulsion and ballast units 120, 160 can be readily adapted to the design characteristics of these specialized containers. For example, containers that will be regularly used for primitive beach operations can be provided with a reinforced lower hull to withstand beaching episodes.

In an alternate embodiment all or key elements of the transporter (propulsion and ballast units 120, 160) are integrated into the container 105, at the expense of some internal cargo space. This alternative preferably provides the transporter functions substantially within the overall dimensions of a standard container 105. This feature allows the containers 105 to be packed on the standard loading interval aboard the container ship and minimizes wasted volume in transport. The integral transporter also precludes any need for handling the transporters as separate items, whether prior to loading or on board the container ship, if the transporters and the containers are stowed separately.

The Propulsion Unit.

In the preferred embodiment, a propulsion unit 120 includes all the major motive and control subsystems in a convenient (i.e., quick attach and stackable) form factor. These major subsystems include an engine 127, a propulsion system 122, a steering system 124 and connectors 112. Other subsystems such as various electronics 135, service interfaces 132, 145, snorkel 114, and rollers 148 may also be used. Thus, the propulsion unit 120 may house all the essential equipment to provide an ASCC with its autonomous swimming capability.

The engine 127 provides motive thrust to power a jet nozzle, propulsor, impeller, shrouded propeller 122 (via shaft 123) or other propulsion subsystem. The preferred engine 127 is a combustion engine in view of the maritime environment, but other engines may also be used. For combustion engines, since most of the propulsion unit 120 is typically submerged when in use, air may be provided via a snorkel 114, allowing the engine to continue functioning even if the propulsion unit 120 is overtopped by waves.

The engine 127 is also supplied with sufficient fuel storage 131 to power the container during underway operations, which could include extensive loitering and return trips. Rather than store fuel in the tank 131 while not in use, a fuel port 145 can be used, fueling at a shipboard deployment station (172 of FIG. 8) just before launch. An oil tank 130 or reservoir may also be advantageous, allowing the engine oil to be stored separately during extended periods (e.g., months or up to years) of non-use, yet readily available before operation. Dry sumps, swinging pickups, and the like may be useful because of the rolling sea states in which the engines will be operating.

Some illustrative alternative embodiments include: a non ignition fired power plant using JP-8 as a common fuel is utilized within the ASCC; a commercial off-the-shelf diesel engine, such as high performance engines found in U.S. Army "Hummer" jeeps; and more expensive state-of-the-art, lightweight engines (such as those presently available from the Two Stroke International division of AMW Cuyuna Engine Company, Inc. of Beaufort, S.C. or those available from Rotary Power International, Inc. of Wood Ridge, N.J.). Moreover, ballasting (fore and aft) may be used for carrying extra fuel for extreme travel requirements. In this way, fuel may be added to match mission requirements. A quick attach fuel transfer line may be used for shifting ballast for and aft, and to supply fuel to the power module.

The propulsion subsystem, in addition to propulsor/shaft units 122, 123, also includes appropriate water inlets 128. Special features such as gear reduction, impeller diffusers, reverse gearing, counter-rotating propellers, strakes, etc., are matters of design choice for the skilled designer. The steering subsystem follows the propeller 122, and may be easily implemented using vertical steering vanes 124. These are housed within the exhaust shroud of the propeller housing to ensure they are protected from damage and that there is adequate structural strength the resist the control forces. However, other rudder or fin structures may be used, and may be controlled by any of a variety of maritime systems like electrical linear actuators, bell cranks, hydraulic or pneumatic systems, etc. Reverse thrust may be achieved by fully closing vanes, channeling the thrust to the sides and forward. Thrusters may also be used for close-quarter maneuvering, and anti-pitch/counter-roll fins 125 may be similarly useful.

An electronics module 135 provides the desired level of control features, from simple steerage to sophisticated communications 136, navigation 137, engine control 138, sensor and data store and processing 139 functionality. In simpler implementations, there may be little more than a steering controller, coupled to a preset navigation routine supplemented by directional (e.g., compass or inertial) inputs.

However, significant operational advantages are obtained as more sophisticated electronics are used. An engine controller 138 can monitor more typical high-performance engine routines (e.g., fuel quantity, rail pressure, injection timing, boost pressure, and exhaust gas recirculation, as well as diagnostics and fault handling). More precise navigation can be achieved with GPS (Global Positioning System) units, RF or optical directional beacon sensors, or even radar and sonar systems coupled with advanced positioning and maneuvering routines. The communications module 136 can permit a wide variety of information to be sent or received, by wireless (e.g., RF or narrowbeam optical) or wireline (e.g., local access via Comm Link (bit-byte) 132). Some illustrative applications are discussed more below, and include anything from simple interrogation (ID, container contents) and navigation commands, to complex network-centric real-time control and data flow. In addition to serving as an air conduit, collapsible snorkel 115 may conveniently be used as a platform for communications antennae or optical transceivers, navigation lights, sensors, and the like.

An onboard processor and memory 139 permit advanced routines for the control of the ASCC and communications with others. In addition to advanced navigation control, these also enable local storage of the container information (e.g., ID and contents). Coupled with a communications system, these permit the remote interrogation of ASCCs to determine the cargo, set landing and off-loading priorities, re-route or even abort deliveries, all based on an informed and detailed understanding of the contents of the ASCCs being interrogated.

Additionally, a local power supply (e.g., battery, fuel cell) may be included, or these may be omitted by use of a starter/generator combination, started before launch. It is also possible to use an all electric or hybrid motor plant, although such would likely have a significantly shorter storage life before more time consuming recharging must be undertaken. Recharging could be accomplished via starter port 132, although the typical use of such would be to conserve power (or enable electric starting in a battery-free unit) during the high-load starting process. Other starters could also be used, such as air starters using a pneumatic link or onboard compressed gas. An optional accumulator may be added to allow an at-sea re-start if the engine stalls. This accumulator would be stored in a low pressure state and initially charged by the ASCC engine driven compressor at startup. Auxiliary units 140 and 146 are illustrative of the numerous other electronic or propulsion subsystems that could be added (e.g., sensor controls, ballasts, scuttling devices, etc.), as will be appreciated by those skilled in the art. Sea water bladders may serve, for example, to further lower the ASCC further in the water to enhance sea keeping and stability, or its aft to maintain a nose-up as approaching the shoreline (and to reduce radar signatures, for military applications).

A propulsion unit 120 is preferably coupled to the container utilizing readily available intermodal connectors of any of the various commercial designs, as will be appreciated by one skilled in container transport. The connectors 112 grip the cargo container at the corner lifting/tie down points at each of the corners of one end of the container 105. To help keep a seal on the container 105, the rear propulsion unit 120 would typically be coupled via connectors 112 to the front of a container 105, thus positioned adjacent the container doors and keeping them in a rearward facing orientation during autonomous transport.

Finally, both propulsion and ballast units 120, 160 preferably include rollers 148, 168. These both protect the ASCC bottoms and provide enhanced mobility for the containers as they arrive shore-side, allowing the ASCCs to be towed or pushed instead of requiring a crane to lift them into place on a specialize vehicle. While fixed steel rollers will be the most common, other forms (e.g., resilient or retractable wheels or cylinders) may be used. Auxiliary dolly units may also be included, allowing easier movement of the propulsion unit 120 when separate from an ASCC.

The Ballast Unit.

Figure 5:
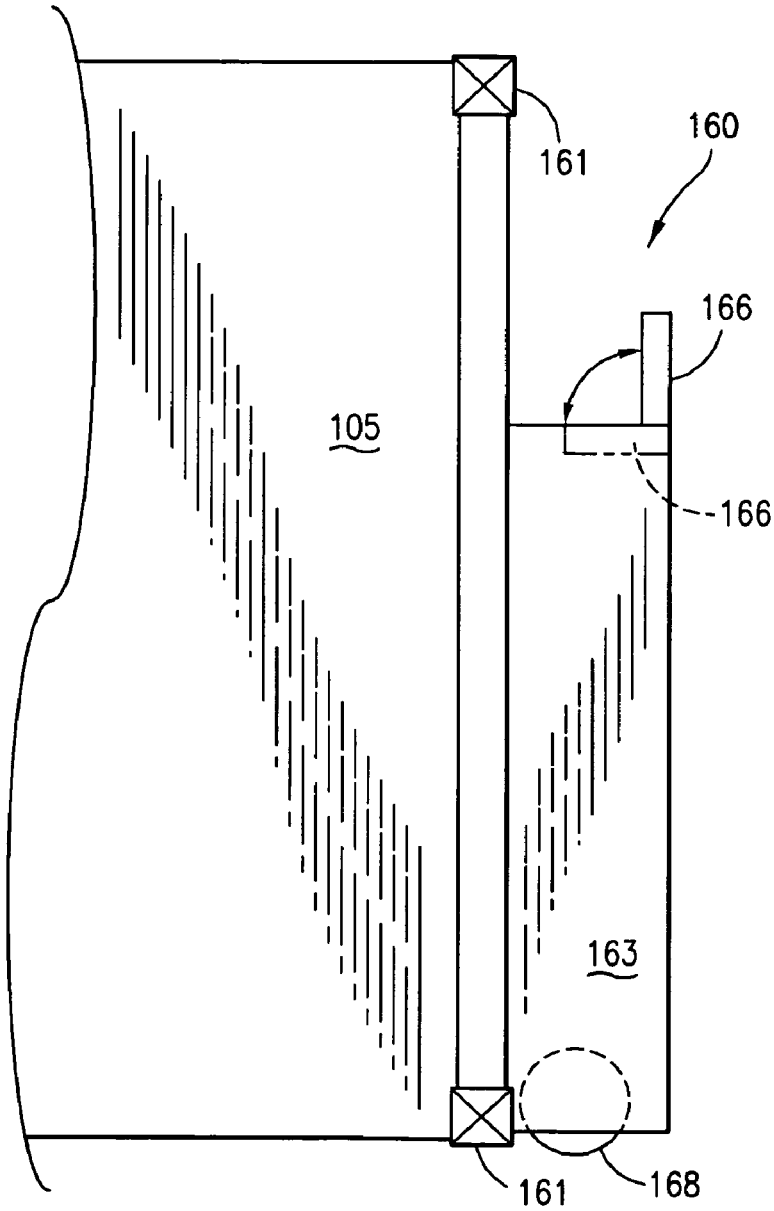
FIGS. 5 through 7 are side, front, and side perspective views, respectively, of a fore ballast unit illustrative of a first embodiment of the invention.
Figure 6:
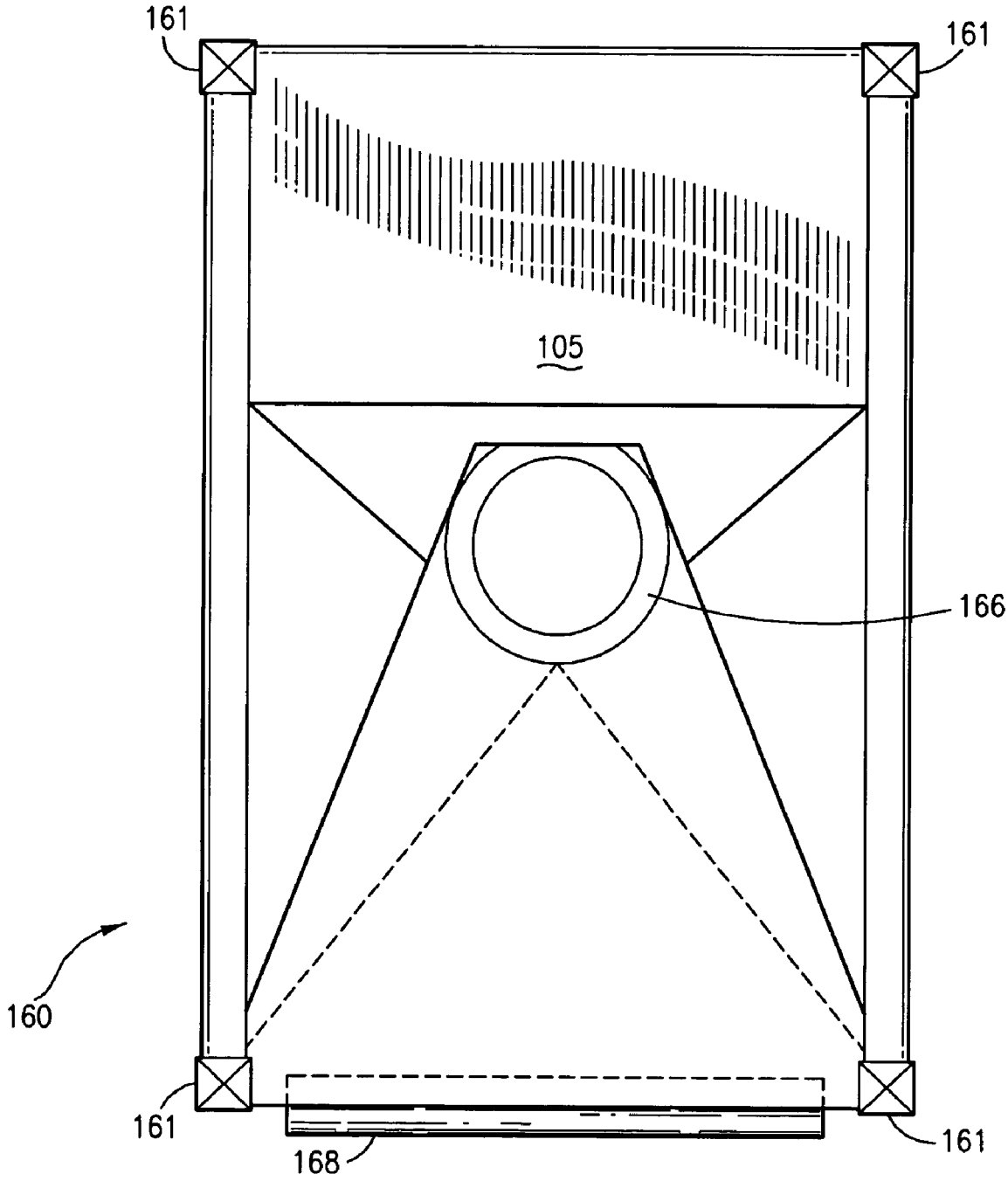
Figure 7:
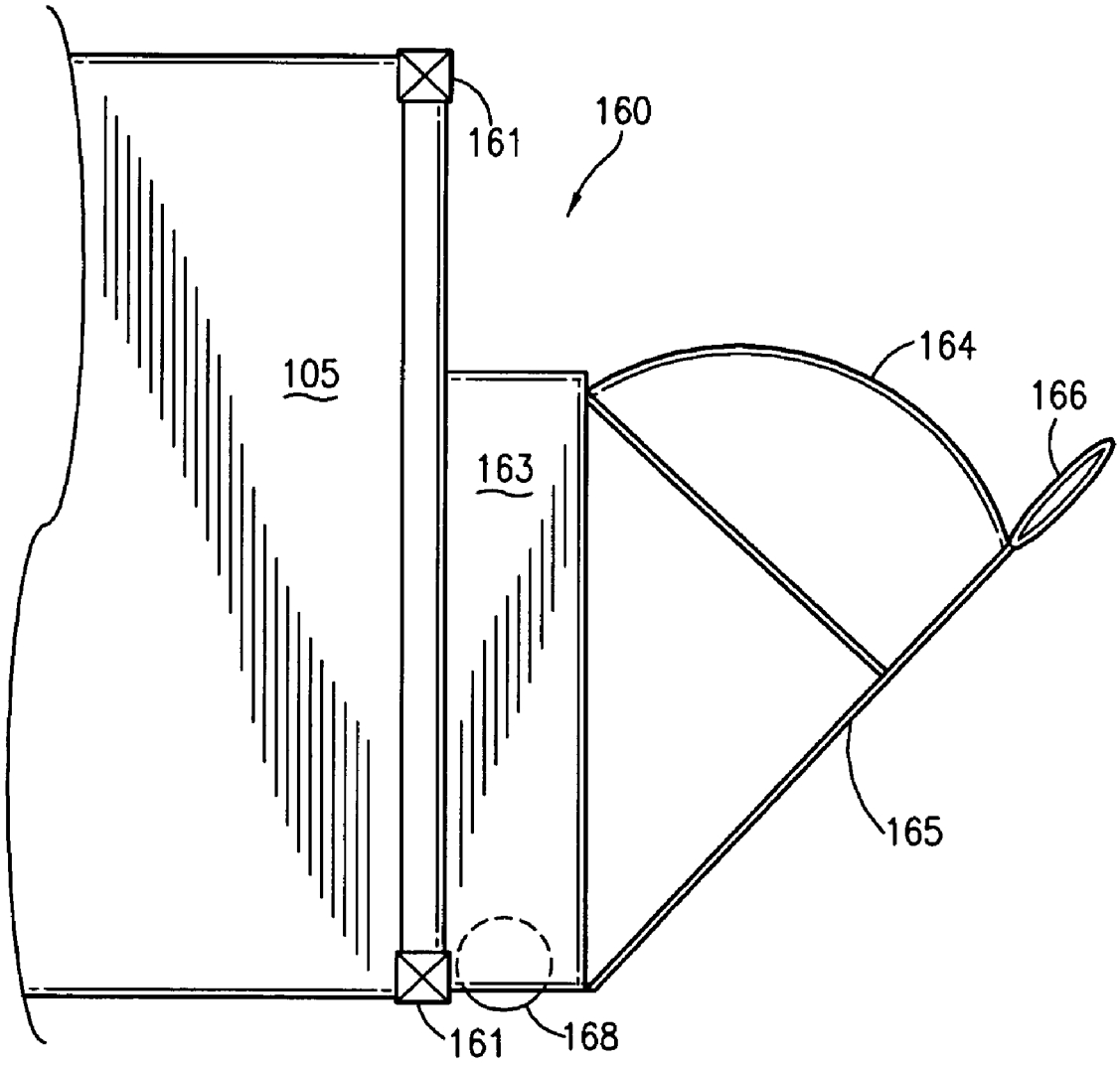

Referring now to FIGS. 5 through 7, a preferred embodiment of an ASCC ballast unit 160 is shown. One of the purposes of this unit is to assist with keeping the front of the ASCC higher in the water, ensuring the propulsor remains submerged in all sea states, and making it easier to beach ASCCs closer to shore and drag them out of the surf zone. In some operations the ballast unit 160 may be unnecessary. In others the functional design may dictate that certain of the propulsion unit subsystems (e.g., nav light, electronics) be optionally included as part of the ballast unit 160 instead of the propulsion unit 120.

In the presently preferred embodiment, a ballast unit 160 includes a ballast unit 164, retrieval bracing 165, a capture unit 166, rollers 168, and container connectors 161. The connectors 161 and rollers 168 are preferably the same as connectors 112 and rollers 148 of the propulsion unit 120. The ballast unit 164 may be any medium capable of displacing water, whether inflatable (e.g., a bladder), or a fixed-shape structure (foam core, fiberglass, or the like.) The capture unit 166 may be as simple as a capture ring, but can include any appropriate device used in moving heavy objects, i.e., a heavy (typically up to 40 tons) container, when full. Other examples of capture units include a ball and socket unit, a male/female adapter, probes, etc. Similarly, the retrieval bracing can be fixed (e.g., a metal plate or bars) or extendable (e.g., a retractable coil), capable of bearing high-loads such as found when dragging a 40 ton container over difficult (e.g., sandy or uneven) ground. One advantage of the extendable bracing/coil is that the land vehicle that will be used for towing the ASCC can remain further away on firm land and still hook up to the ASCC for winching or dragging it onto the land.

Both the capture ring 166 and ballast unit 164 may be stowed in a narrow form factor when their full deployment is not needed (see the illustration of FIG. 5).

Deployment Systems.

Figure 8:
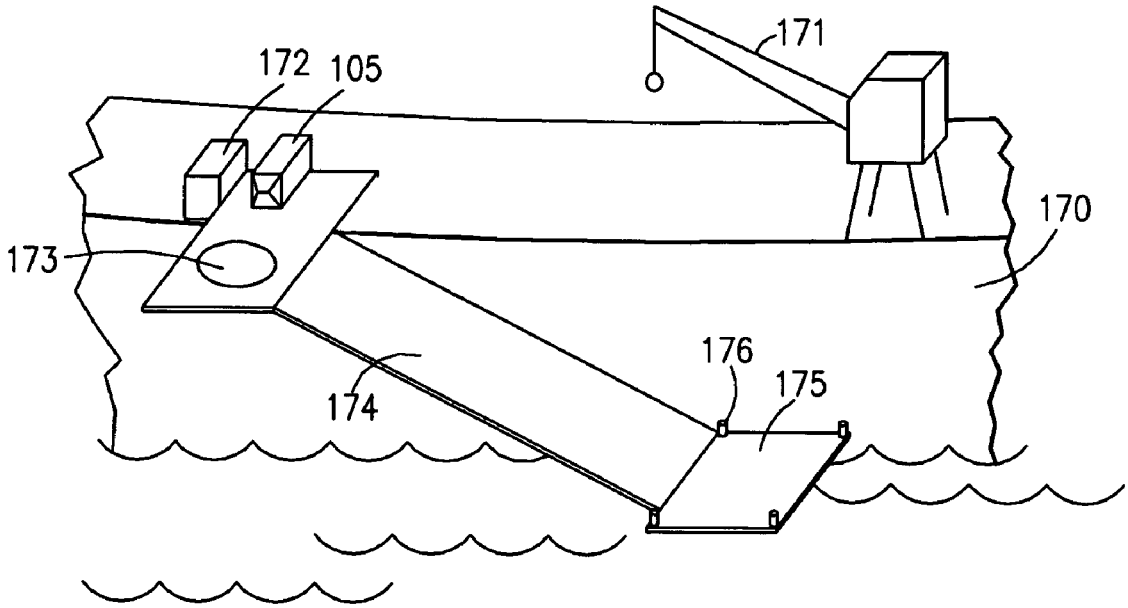
FIG. 8 is a side perspective view of an illustrative embodiment of a shipboard container loading/off-loading system according to a further embodiment of the invention.
Figure 9:
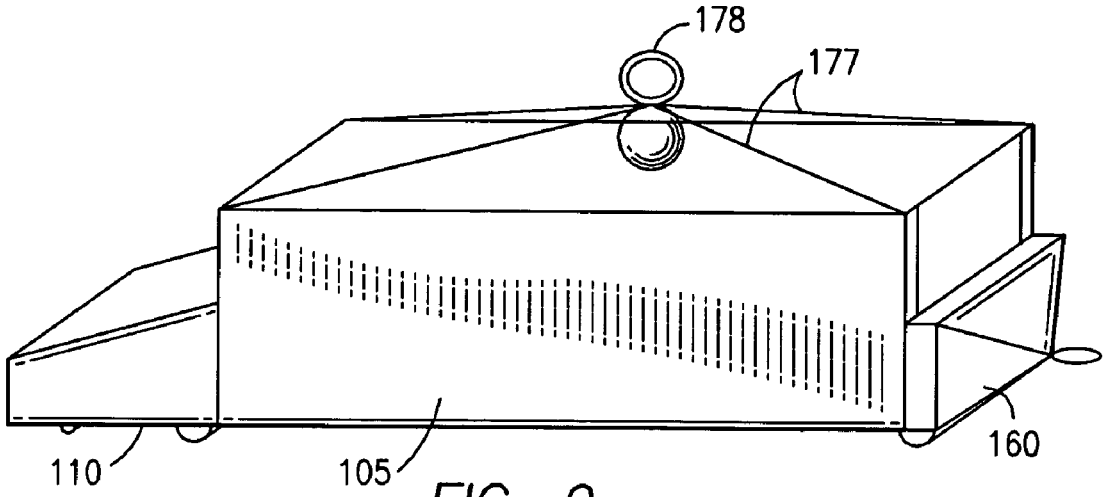
FIG. 9 is a perspective view of a container with attached propulsion, ballast, and loading/off-loading units illustrative of a further embodiment of the invention.

An embodiment of a shipboard deployment system and operations may now be discussed in connection with FIGS. 8 and 9. This particular illustration is of a ship 170 with a side-loading capability. However, a skilled artisan will appreciate how any convenient launch approach is possible, whether by crane, slide, "soda can" chutes, aft and side RO/RO (roll-on/roll-off) ramps or platforms that lower into the water, or other. Similarly, recovery can be by crane, platforms, etc., limited only by the particular ship design.

In the illustrated case, ship 170 includes a movable deployment slide that can be swung into position for ASCC launch, and securely stowed until needed. When deployed, the slide includes an upper platform and turntable 173 (to reduce container wear and speed up the launch process), a slide 174, and submersible platform 175. When readying an ASCC for launch, it is fueled and readied at station 172. The re-fueling operation can be via a controlled pressure re-fueling similar to that already in use with aircraft, to reduce hazards and spills while rapidly refueling the vehicle. This pressurized fueling could also provide the driving force to inject lubricant into the engine sump (if the engine selected requires lubricant in its oil sump).

As part of this deployment process, a diagnostic self check (bit check) is executed after a power and communications link are connected. The bit check can include GPS activation (inertial or other navigation systems if used) and verification, inventory verification, navigation light operation (if needed), arming the scuttle system (if required), steering and ballasting control system readiness, engine diagnostics and power control verification and crypto code authentication (if used) as well as successful inventory and navigation data upload. Additional information down- or up-loaded to ASCC processor/data store 139 is transferred via Comm Link 145. The status, and any alarms, may be displayed either locally to seaman at station 172, or to other control monitors on the ship 170. If needed, the ASCCs may be deployed using all modes simultaneously—slides, cranes, and RO/RO ramps.

If the status check is successful, the ASCCs snorkel is deployed and engine started, and then lowered into the water.

The ASCC units are typically attached to the standard containers prior to bit check so as to not disrupt the off-load operations sequencing. During transport the propulsion and ballast units can be conveniently stacked inside a container. The ASCC outer dimensions should allow a wedged stowage within a container to: (1) allow dense pack/stacked stowage within a storage ISO container; (2) ensure that the propulsor is submerged in all sea conditions; (3) allow beaching with minimal damage to the transporter unit; (4) reduce drag and (5) assist hydrodynamic streamlining. A single, balance point, lifting point attachment shall be used to allow easy movement of the transporter units (and optional forward balance bladder) into and out of the storage ISO container, coupling and decoupling for operation and simplified attaching/detaching of the ASCC from the units.

The breakout plan for each ship may be a standard Last In First Out (LIFO) approach. However, since the inventory can be readily determined by local data storage systems (e.g., the ships inventory database), the containers can be loaded or re-arranged to further streamline off-loading based on destinations and priority cargo at each destination (which can be changed on the fly). If the ASCCs are not equipped with local data storage, electronic remote fill (ERF), or like, an externally listed inventory scheme, such as a Bar Code may be used for confirmation and field selection of critical loads.

Standard handling equipment for stowage operations may be used with standard deck load-out and tie downs. No special tools should be required in a typical launch, nor highly skilled personnel, extensive personnel training or modifications to the standard ISO shipping containers. Military Sea Lift and or commercial ships can be used.

If desired, multiple transporter modules may be assembled as a single lift unit aboard ship, with multiple ASCC containers attached. In an embodiment, these could be made up of the military's current standard causeway modules (used for JLOTS operations) paired together to reduce the causeway construction time or causeway modules paired or doubled paired (with four ASCC containers) or more to allow heavy equipment to be ferried in atop the assembly to close along side the causeway for direct off-load or to be beached to support causeway construction.

Finally, if communications are lost or there is an engine failure close to the larger container ship, a retrieval vessel may be used to capture the unit and reload aboard the container ship for ASCC change out or an onboard scuttle system could be remotely activated to sink the failed unit if it is a danger to navigation. This scuttle system may, for example: operate by use of a reversible bilge pump system (continuously on); via a water sensor; and even be located internal to the ISO container instead of as a component of the propulsion unit. Alternatively, the system could operate in an over-pressure mode, powered by an external compressor unit, to maintain elevated air pressure inside the container, thereby preventing water leakage. Also, when an ASCC returns to a ship, convenient attachments such as the cable and hoop 177, 178 of FIG. 9 allow for quick capture, despite higher sea states, by a shipboard crane or raising platforms.

Regional Transport/Inventory System and Operations.

Figure 10:
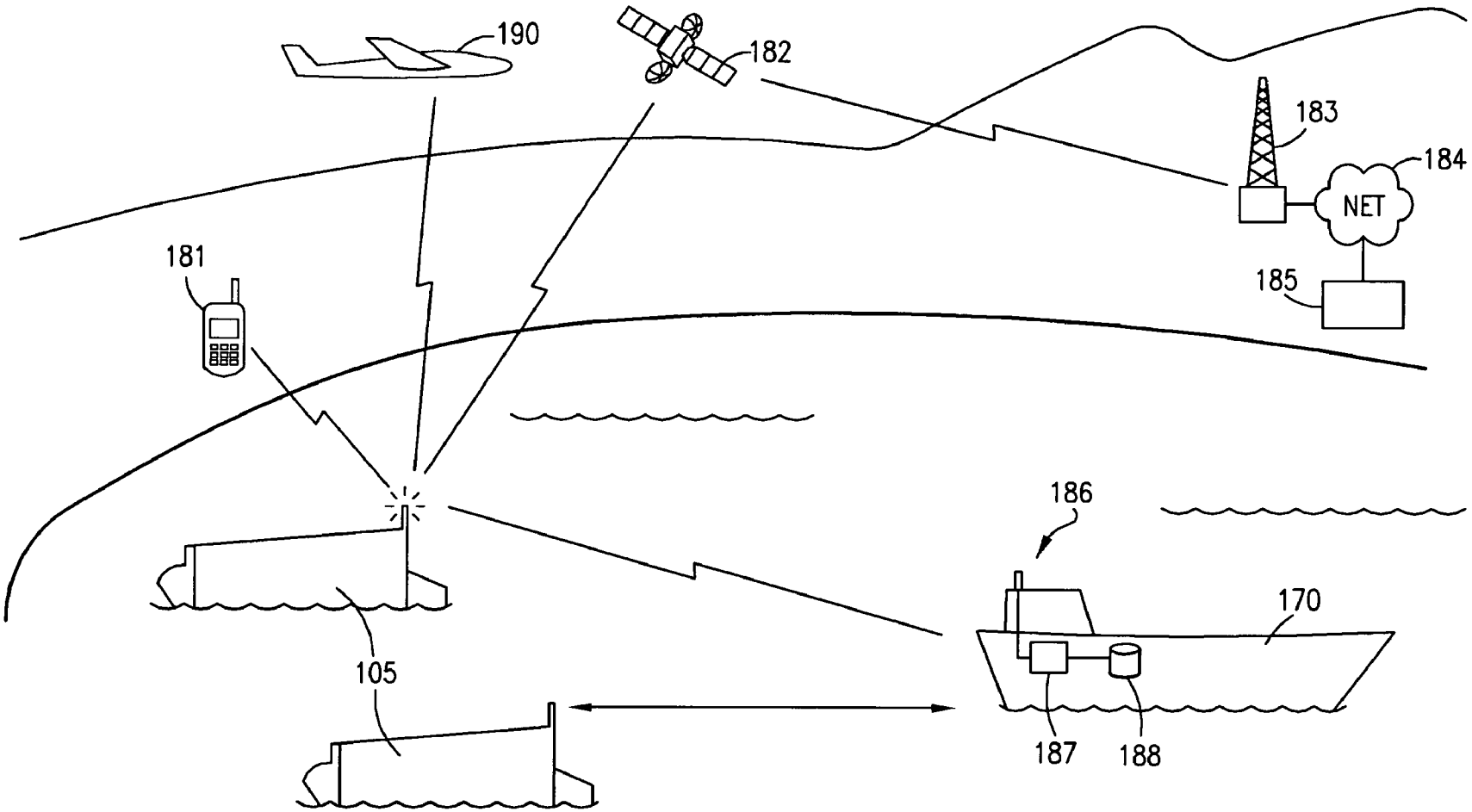
FIG. 10 is a diagram illustrating an operational context for movement, control and interrogation of the self-propelled containers of FIG. 9.

Turning now to FIG. 10, an overview of a regional transportation and inventory control system is illustrated. Depending on the optional features implemented, an ASCC System allows for autonomous maritime transport of ASCCs to a wide variety destinations, with an overlay of remote control and information sharing features. Illustrating some of the possible remote units in communication with the ASCCs are container ship 170, a headquarters center 185 (via satellite 182 and network/transceiver 183,184), and wireless PDA 181 of field personnel at a shore side destination. Each of these units has its own processors and data stores (e.g., see local computer system 187 and database 188 on ship 170). However, those skilled in the art will appreciate how any communications-enabled unit, or even objects detectable to ASCC onboard sensors (beacon receivers, radars, etc.), can be used in the course of autonomously or remotely controlling ASCCs within a regional system.

By way of overview of a transport/inventory operations, operations commence with the discharge of ASCCs (i.e., containers with at least a propulsion unit 120) from a container ship 170 located at a convenient discharge point. One advantageous feature of the ASCC system is that container ships can discharge ASCCs far away from the ultimate destination—easily over 150 km—and even while underway within remote sea lanes. Because of the robustness of the ASCC configuration and flexible deployment options, ASCCs can also be launched in conditions above sea state 3. Further, launches could range from a single container (e.g., with humanitarian relief cargo to a small village), to hundreds or thousands of containers from one or more ships.

Because of the data maintained about each ASCC's cargo, all ASCCs remain part of the regional logistics inventory and transportation system until off-loaded at their destination. The contents, location, destination, and planned route can be shared with all authorized users, as well as any other sensor data collected by the individual containers. This in turn permits dynamic, real-time re-routing of containers to destinations with the highest priority need for its contents. In addition giving shore side personnel visibility to a wide array of information, local control can also be passed to these personnel for ASCCs within their area. Thus, those with responsibility for local logistics can—via use of communications/processor equipped devices like PDA 181, appropriately programmed with suitable database programs and logistics algorithms—control the orderly arrival of containers at the appropriate staging points. Because of the extended transport capabilities of an ASCC, they can be as readily inventories at sea, in orbiting or other controlled patterns, as at the typically more crowded shorelines.

This system gives unprecedented control, scalability and flexibility for delivery of cargo, using the most efficient transportation vessels available. It is readily adaptable to the latest inventory and navigation technologies, since any of the various control points (ASCC, ship, shore or headquarters) can be updated on the fly, limited only by the particular hardware/software design choices implemented for each given unit. Whether fuzzy logic, swarming algorithms, ERP-level logistics control, or just simple navigation routines are desired, a skilled artisan can implement his or her system of choice using the features offered by the ASCC system. It also allows large shippers, whether civilian or military, to dispense with a wide variety of expensive, specialty vessels. Because of the relatively smaller cost of individual ASCCs, planners can even risk the loss of a number of ASCCs in harsh or hostile environments, knowing that sufficient volume of time-critical deliveries will still make it through given the survivability and numbers of ASCCs. The same cannot be said of prior maritime transport options, where entire operations have been stalled for days or more waiting for more favorable conditions.

The containers may head directly to a specific beach locale according to the preloaded transit plan (verified by its internal GPS/INS equipment), navigate via waypoints prior to the beach landing locale according to the preloaded transit plan (verified by internal its GPS/INS equipment), or loiter in a waiting area offshore until summoned by radio or according to the preloaded transit plan (verified by its internal GPS/INS equipment). The containers may be addressed specifically by coded radio command to pass lower priority cargo en route to the beach if changing requirements dictate, otherwise they navigate themselves to the beach. Upon reaching the shore, the containers are then extracted from the water.

While the fastest embodiment is likely to be single use ASCCs, many ASCCs will be capable of round trips between ship and shore. This can be accomplished by motoring the empty ASCCs to a retrieval ship. Alternatively, the transporters (propulsion and ballast units 120, 160) may be decoupled from their container 105 at the shore, repacked with other transporter pairs in a return ASCC container, and unpacked at the ship for use with other containers. In this manner, only a small number of transporters are needed per ship, allowing cargo to be maximized and space used for transporters minimized. The particular numbers are a mere logistics issue, readily optimized depending on the expected transport routes and delivery rates.

While the embodiments discussed above are particularly useful in opening up commercial container deliveries to ports and shore side communities unable to afford expensive container terminals, it is also easily adapted to emergency (relief or hazardous) and military operations. In some respects, the distributed delivery and control systems are particularly suitable for the complex, hazardous, and time-critical logistics deliveries required by modern military forces. By way of example, it could be utilized by the military, fully compliant, for use in the Joint Logistics Over-The-Shore (JLOTS) environments. Such environments include the loading/unloading of ships without fixed port facilities, in both hostile and friendly territory, even with enemy opposition. By allowing distributed and dynamic control, the risk to personnel and critical assets is greatly reduced, along with the overall system costs, while logistics flow rates are substantially increased.

Conclusion

Thus, the present invention provides an improved maritime logistics and cargo transportation system, including autonomous swimming cargo containers, and process for operating such. The autonomous and distributed, yet optionally fully networked, approach allows for significant cost savings, with greatly more scalable, flexible and efficient capabilities than has been possible before. Of course, those skilled in the art will appreciate how a variety of alternatives are possible for the individual elements, and their arrangement, described above, while still falling within the scope of the invention. Thus, while it is important to note that the present invention has been described in the context of a particular ASCC embodiment, those of ordinary skill in the art will appreciate that the components and processes of the present invention are capable of being further distributed or aggregated with others, and implemented in a wide variety of ways.

Further, while certain benefits of have been described in connection with the embodiment above, many more will be evident and applicable to the present invention. Some of these benefits include: a large transport ship may remain in the sea lanes or outside of coastal waters and still deliver its cargo rapidly, safely and in large volumes; there is a substantial (seven-fold or more) increase of large container ship off-load rate (compared to at sea cargo transfers to intermediate ships) attained by its utilization, e.g., because all available transfer cranes can be utilized simultaneously with each operation significantly shortened; it provides a significantly increased tonnage (up to twenty-fold or more) to less developed shore side areas, resulting in part since the ASCCs are able to wait off shore, readily available to be brought ashore as rapidly as the available handling equipment can accept them, thus eliminating the wait for lighter ships to return with additional cargo; ASCCs can be directed to "land" simultaneously along the shore line; it significantly decreases (up to twenty-fold or more) the personnel required for logistics operations, resulting because there is no requirement for lighter ships and their crews, as well as no requirement for extensive fabrication assemblies on the beach and their associated construction personnel; it allows the reordering of cargo shore arrival times while the containers are still at sea to address changing priorities on shore or arrival of specific transportation vehicles by remotely adjusting the speed/time-of-arrival for selected individual ASCCs.

In conclusion, the above description has been presented for purposes of illustration and description of embodiments of the invention, but is not intended to be exhaustive or limited to the form disclosed. These embodiments were chosen and described in order to explain the principles of the invention, show its practical application, and to enable those of ordinary skill in the art to understand how to make and use the invention. Many modifications and variations will be apparent to those of ordinary skill in the art. Thus, it should be understood that the invention is not limited to the embodiments described above, but should be interpreted within the full spirit and scope of the appended claims.

We claim:

1. A maritime cargo system comprising plural autonomous containers, each autonomous container comprising:

a transporter for moving a watertight commercial container through a body of water when at least partially submerged in water, comprising:

a propulsion system, comprising:

a connector apparatus for coupling the transporter to the commercial container;

a propulsion apparatus; and a control apparatus operable for navigating the transporter;

a ballast apparatus operable for coupling to an opposite end of the container from the propulsion system and providing buoyancy to the commercial container with at least partially submerged in water, the ballast apparatus comprising:

a buoyancy unit, a capture unit, connectors operable for coupling the ballast apparatus to the container, a roller and a retrieval bracing coupled to the capture unit, wherein the buoyancy unit comprises one of an inflatable unit, a foam core, a fiberglass, and other fixed-shape unit, and the capture unit comprises one of a fixed or extendable ring, adapter unit, probe, and ball and socket member; and a retrieval apparatus comprising connectors operable for coupling to at least one of the container, and the propulsion system and ballast apparatus.

2. The maritime cargo system of claim 1, further comprising a deployment system including a ship, the ship comprising a deployment preparation apparatus and a launch apparatus.

3. The maritime cargo system of claim 2, wherein the deployment preparation apparatus comprises a data upload unit, a fueling unit, and a start unit operable for uploading one of container and navigation information to the transporter, fueling the transporter, and initiating start of the propulsion system; and the launch apparatus comprises at least one of a crane, slide, chute, ramp or movable platform.

4. The maritime cargo system of claim 1, further comprising remote control units operable for sending and receiving information from the autonomous containers.

5. The maritime cargo system of claim 4, wherein the remote control units are one of maritime vessel, an airborne unit, a fixed or mobile terrestrial unit, and a space unit, each having a processor unit operably coupled to a communications unit; and wherein the processor unit comprises instructions configured to perform at least one routine of tracking the movement of, controlling the propulsion system via the control apparatus of, requesting and receiving data from, and providing information to, each of plural of the autonomous containers.

6. The maritime cargo system of claim 1, wherein plural transporters are included as cargo of a commercial container.

7. A self-propelled container (SPC), comprising:

a watertight commercial container of a type used for transportation of cargo by both land and sea transportation systems;

a maritime transporter coupled to and operable for moving the commercial container through water when both the maritime transporter and commercial container are moved into and at least partially submerged in a body of water, including:

a propulsion apparatus and a control apparatus operable for navigating the SPC; and a ballast apparatus operable for coupling to an opposite end of the container from the propulsion system.

8. The SPC of claim 7, wherein the control apparatus comprises a navigation module, a propulsion control module, and a communications module; and the propulsion apparatus comprises an engine and a steering apparatus.

9. The SPC of claim 7, wherein the ballast apparatus comprises a buoyancy unit, a capture unit, connectors operable for coupling the ballast apparatus to the container, a roller and a retrieval bracing coupled to the capture unit.

10. The SPC of claim 9, further comprising a retrieval apparatus comprising connectors operable for coupling to at least one of the container, the propulsion system and ballast apparatus.

11. A lift unit for maritime transport of heavy equipment, comprising plural SPCs of claim 7 operably coupled together to transport the heavy equipment on the lift.

12. A maritime cargo container delivery system for moving a watertight cargo container of a type used for transportation of cargo by both land and sea transportation systems, comprising:

a transporter that couples to a cargo container, the transporter comprising:

a propulsion system operable to drive the coupled transporter and container through the water when both the maritime transporter and commercial container are moved into and at least partially submerged in a body of water;

a controller operable for communications with remote units and controlling the travel of the container through the water; and a ballast unit coupled to the container opposite the propulsion system.

13. The system of claim 12, wherein the controller further comprises a navigation processor operable for determining location and course based on information from one of satellite positioning system or an on-board guidance system.

14. The system of claim 12, wherein the transporter is reusable independent of the container, further operable for additional deliveries after first decoupling the transporter from the original container and coupling with a new container with the same or different cargo.

15. A self-propelled container (SPC), comprising:

a watertight intermodal container of a type used for transportation of cargo by both land and sea transportation systems;

a maritime transporter coupled to and operable for moving the intermodal container through water when both the maritime transporter and intermodal container are moved into and at least partially submerged in a body of water;

a deployment system including a ship, the ship comprising a deployment preparation apparatus and a launch apparatus; and remote control units operable for sending and receiving information from the SPC's.

16. The maritime cargo system of claim 15, wherein the remote control units are one of maritime vessel, an airborne unit, a fixed or mobile terrestrial unit, and a space unit, each having a processor unit operably coupled to a communications unit; and wherein the processor unit comprises instructions configured to perform at least one routine of tracking the movement of, controlling the propulsion system via the control apparatus of, requesting and receiving data from, and providing information to, each of plural of the autonomous containers.

* * * * *